United States Patent [19]

Aldridge et al.

[11] 4,369,106

[45] Jan. 18, 1983

[54] COAL LIQUEFACTION PROCESS

[75] Inventors: Clyde L. Aldridge; Roby Bearden, Jr., both of Baton Rouge, La.

[73] Assignee: Exxon Research and Engineering Co., Florham Park, N.J.

[21] Appl. No.: 244,082

[22] Filed: Mar. 16, 1981

Related U.S. Application Data

[63] Continuation-in-part of Ser. No. 138,822, Apr. 10, 1980, abandoned.

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 2,756,194 | 7/1956 | Mayland | 208/10 |
| 3,813,329 | 5/1974 | Gatsis | 208/9 |
| 4,077,867 | 3/1978 | Aldridge et al. | 208/10 |
| 4,136,013 | 1/1979 | Moll et al. | 208/10 |
| 4,155,832 | 5/1979 | Cox et al. | 208/10 |
| 4,169,041 | 9/1979 | Schuette | 208/10 |
| 4,196,072 | 4/1980 | Aldridge et al. | 208/10 |
| 4,229,283 | 10/1980 | Sosnowski | 208/10 X |
| 4,269,629 | 5/1981 | Bahn et al. | 208/10 X |
| 4,298,454 | 11/1981 | Aldridge et al. | 208/10 |

FOREIGN PATENT DOCUMENTS

| | | | |
|---|---|---|---|
| 535746 | 1/1957 | Canada | 208/10 |
| 2735609 | 4/1978 | Fed. Rep. of Germany | 208/10 |
| 2729508 | 5/1978 | Fed. Rep. of Germany | 208/10 |
| 2729533 | 5/1978 | Fed. Rep. of Germany | 208/10 |

OTHER PUBLICATIONS

EDS Coal Liquefaction Process Development Phase III A Jan. 1, 1976–Jun. 30, 1977, vol. 1 Exxon Research and Eng. Co., Baytown Reserach and Development Div. p. 153.

*Primary Examiner*—Delbert E. Gantz
*Assistant Examiner*—William G. Wright
*Attorney, Agent, or Firm*—Marthe L. Gibbons

[57] ABSTRACT

In a process for catalytically converting coal in a diluent wherein the catalyst is prepared in situ in the coal-diluent mixture by converting a metal compound to a metal-containing catalyst, the metal compound is added to the coal-diluent mixture in a liquid medium comprising at least 30 weight percent of a phenol.

22 Claims, 2 Drawing Figures

FIGURE I

COAL LIQUEFACTION PROCESS

CROSS REFERENCE TO RELATED APPLICATIONS

This application is a continuation-in-part of U.S. patent application Ser. No. 138,822 filed Apr. 10, 1980now abandoned, the teachings of which are hereby incorporated by reference.

BACKGROUND OF THE INVENTION

1. Field of the Invention

This invention relates to an improvement in a process for hydroconverting coal to liquid hydrocarbon products in the presence of a metal-containing catalyst prepared in situ from a catalyst precursor added to the slurry of coal and diluent.

2. Description of the Prior Art

A coal hydroconversion process is known in which coal, in a hydrogen donor diluent, is liquefied in the presence of a catalyst prepared in situ in the coal-hydrogen donor mixture from catalyst precursors which may be heteropoly acids, such as, for example, phosphomolybdic acid, molybdosilicic acid, etc. See U.S. Pat. No. 4,077,867, column 3, lines 29–30.

The use of heteropoly acids containing a metal constituent of Group VB or VIB as catalysts for liquefying coal in a solvent is known. The catalyst may be employed in solution, for example, in water, alcohols, acetone, ethylacetate, etc. Water is particularly preferred. See U.S. Pat. No. 3,813,329.

A catalytic coal liquefaction process is known in which an emulsion of an aqueous solution of a metal salt in a water immiscible liquid medium is added to the coal slurry. The metal salt is a water soluble salt such as ammonium or alkali metal heptamolybdate. See U.S. Pat. No. 4,136,013.

U.S. Pat. No. 4,155,832 discloses hydrogenation of coal at a temperature below 400° C. in the presence of a transition metal dissolved in an organic solvent. Following the hydrogenation step, the hydrogenated carbonaceous material can be pyrolyzed or catalytically cracked.

It has now been found that in coal liquefaction in which a slurry of coal and a diluent is treated in the presence of hydrogen and a catalyst prepared in situ from a catalyst precursor, the addition of the catalyst precursor in a liquid medium comprising a phenol to the diluent will provide advantages that will become apparent in the ensuing description.

The term "hydroconversion" with reference to coal is used herein to designate a catalytic conversion of coal to liquid hydrocarbons in the presence of hydrogen.

The terms "heteropoly acids" and "isopoly acids" are used herein in accordance with the definitions given in *Advanced Inorganic Chemistry*, 3rd Edition, by S. A. Cotton and Geoffrey Wilkinson, Interscience Publishers, New York, pages 950–957.

The term "phenols" is used herein to designate compounds in which one or more hydrogen atom in the aromatic nucleus has been replaced by a hydroxyl group as illustrated by phenol (hydroxybenzene); o-cresol (2-hydroxytoluene), m-cresol (3-hydroxytoluene) etc. in accordance with Degering, *An Outline of Organic Chemistry*, New York, Barnes & Noble, 6th Edition, 1961, pages 189–190.

SUMMARY OF THE INVENTION

In accordance with the invention there is provided, in a process for the hydroconversion of coal in a diluent, which comprises the steps of:

(a) forming a mixture of coal, a diluent and a phenol-soluble metal compound wherein said metal compound comprises at least one metal constituent selected from the group consisting of Groups II, III, IVB, VB, VIB, VIIB, VIII and mixtures thereof of the Periodic Table of Elements;

(b) reacting the resulting mixture with a hydrogen-containing gas at hydroconversion conditions, said metal compound being converted to a catalyst within said mixture at said conditions, and (c) recovering a normally liquid hydrocarbon product, the improvement which comprises adding to said diluent an admixture comprising said metal compound and a liquid medium, said liquid medium comprising at least about 30 weight percent of at least one phenol, based on said liquid medium, and said metal compound comprising not more than about 50 weight percent of said admixture.

DETAILED DESCRIPTION OF THE INVENTION

Figure 1:
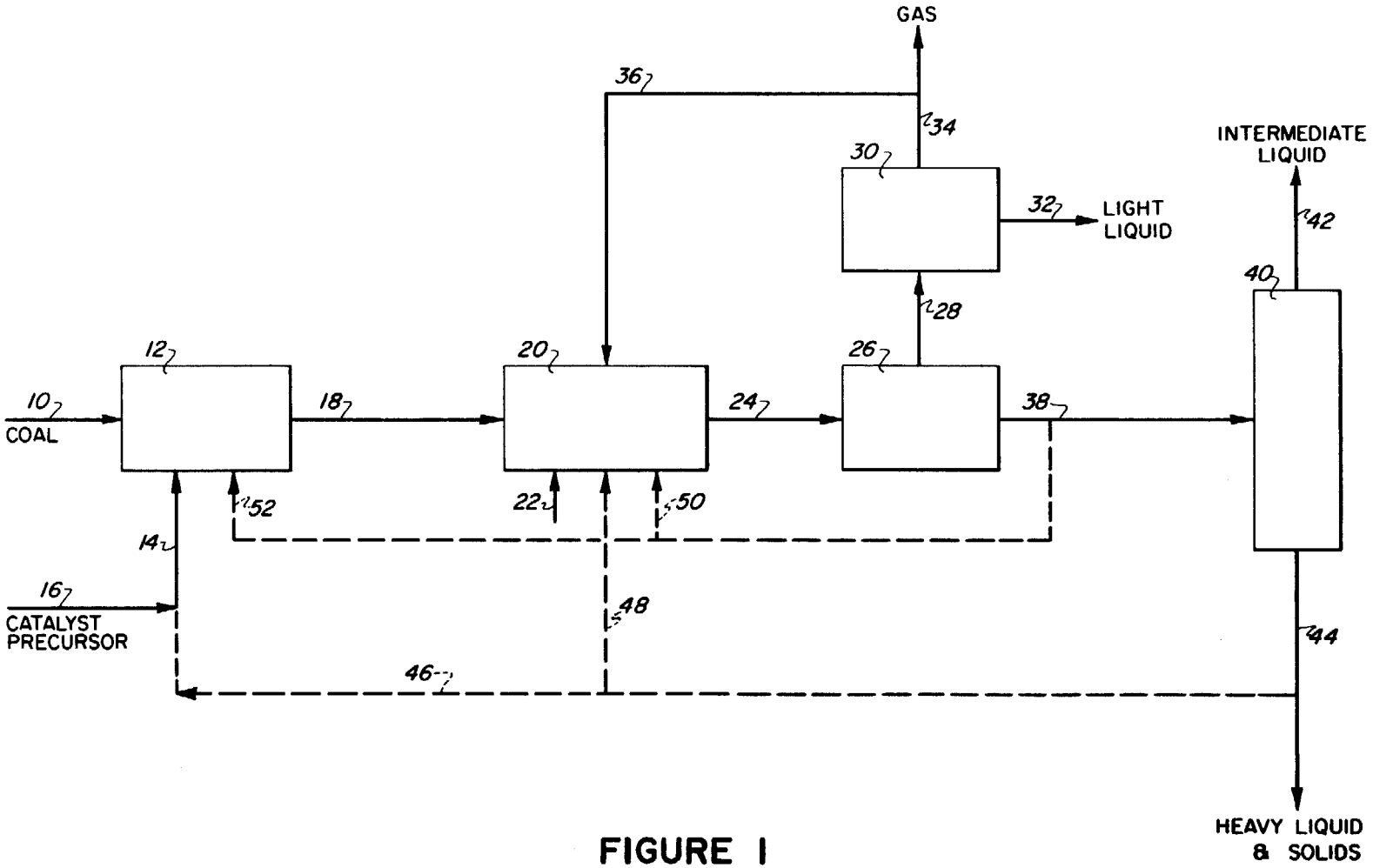
FIG. 1 is a schematic flow plan of one embodiment of the invention.

The process of the present invention is generally applicable to coal hydroconversion processes in which the chargestock of the coal hydroconversion stage is a slurry comprising coal and a diluent.

The term "coal" is used herein to designate a normally solid carbonaceous material including all ranks of coal, such as anthracite coal, bituminous coal, semibituminous coal, subbituminous coal, lignite, peat and mixtures thereof.

The diluent in the practice of the present invention typically will be a hydrocarbonaceous bottoms derived from a coal liquefaction process, for example, a bottoms stream from the process of the present invention. The hydrocarbonaceous bottoms may have an initial boiling point as low as about 350° F., preferably as low as about 550° F., more preferably as low as at least 700° F. All boiling points referred to herein are atmospheric pressure boiling points unless otherwise specified. Other suitable diluents include hydrocarbonaceous streams boiling between 350° F. (176.67° C.) and about 1000° F. (537.8° C.), preferably between about 400° F. (204.44° C.) and about 700° F. (371.11° C.) derived from coal liquefaction processes, which may include compounds that are hydrogen donors under temperature and pressure conditions employed in the liquefaction zone; other hydrogen-rich diluents may be used instead or in addition to such coal-derived liquids; heavy hydrocarbonaceous oils, including heavy petroleum crude oils; residual oils such as atmospheric residua (boiling above about 650° F., i.e. 343.33° C.); petroleum vacuum residua (boiling above about 1050° F., i.e. 565.56° C.); tars; bitumen; tar sand oils; shale oils; light diluents such as aromatic compounds, hydrocarbonaceous compounds or oils boiling below about 350° F. and mixtures of any of these diluents. The diluents may be hydrogen donor diluents or non-hydrogen donor diluents.

To the diluent, either before adding the coal or after adding the coal, is added a mixture comprising at least one phenol-soluble metal compound in a liquid medium comprising at least about 30 weight percent, preferably at least about 40 weight percent, more preferably at least about 50 weight percent, most preferably at least about 75 weight percent, of a phenol or phenol concentrate.

The term "phenol-soluble metal compound" is intended herein to designate that the given compound is initially soluble in phenol. For example, when phosphomolybdic acid is added to a phenol liquid medium, it dissolves in the phenolic liquid medium. After a short period of time, highly dispersed solids appear in the liquid medium. The term "phenol" with reference to "phenol-soluble" is used as previously indicated to designate compounds in which one or more hydrogen atom in the aromatic nucleus has been replaced by a hydroxyl group. If industrial design convenience makes it desirable, a minor amount of water, for example, less than 10 weight percent, preferably less than 5 weight percent, more preferably less than 1 weight percent may be included in the phenolic fraction. The balance of the liquid medium may be, for example, hydrocarbonaceous liquids which may be derived from any source, such as, coal derived liquids, petroleum, shale oil, tar-sand oil and mixtures thereof. Preferably, the balance of the liquid medium is a hydrocarbonaceous oil derived from coal liquefaction processes (i.e. coal liquids), more preferably hydrocarbonaceous coal liquids having an atmospheric boiling point ranging from about 100° F. to about 600° F. The phenol-soluble metal compound may be a single compound or a mixture of compounds. The phenol may be a single phenol or a mixture of phenols. The phenol may be derived from the effluent of the coal liquefaction process by means known in the art, e.g. fractional distillation, extraction, etc. Suitable phenols include phenol (hydroxybenzene); m-cresol (3-hydroxytoluene) and other mono- and polyhydroxy substituted aromatic compounds. The phenol-soluble metal compound may be present in an amount ranging from about 0.02 to about 50 weight percent in the liquid medium, preferably an amount ranging from about 0.1 to about 10 weight percent, more preferably an amount ranging from 0.1 to 5 weight percent based on the total weight of the mixture of metal compound plus total liquid medium. Suitable metal compounds that are initially soluble in a phenol include inorganic poly acids such as isopoly and heteropoly acids; metal carbonyls; metal halides; metal salts of organic acids such as acyclic and alicyclic aliphatic carboxylic acids containing two or more carbon atoms (e.g. naphthenic acids). The metal constituent of the phenol-soluble metal compound is selected from the group consisting of Groups II, III, IVB, VB, VIB, VIIB and VIII of the Periodic Table of Elements and mixtures thereof, in accordance with the Table published by Sargent-Welch, Copyright 1968, Sargent-Welch Scientific Company, for example, zinc, antimony, bismuth, titanium, cerium, zirconium, vanadium, niobium, tantalum, chromium, molybdenum, tungsten, manganese, rhenium, iron, cobalt, nickel, and the noble metals including platinum, iridium, palladium, osmium, ruthenium and rhodium. The preferred metal constituent of the phenol-soluble metal compound is selected from the group consisting of Groups VB and VIB of the Periodic Table of Elements and mixtures thereof. The preferred phenol-soluble compounds are inorganic poly acids including isopoly acids and heteropoly acids of metals selected from the group consisting of Groups VB and VIB and mixtures thereof of the Periodic Table of Elements, that is, vanadium, niobium, chromium, molybdenum, tungsten and mixtures thereof. Suitable inorganic poly acids include phosphomolybdic acids, phosphotungstic acid, phosphovanadic acid, silicomolybdic acid, silicotungstic acid, silicovanadic acid and mixtures thereof. The preferred metal constituent of the poly acid is selected from the group consisting of molybdenum, vanadium and chromium. The preferred poly acid is a phosphomolybdic acid. If desired, phosphoric acid may be used in combination with the poly acid as described in U.S. Patent Application Ser. No. 909,200, the teachings of which are hereby incorporated by reference.

Optionally, the liquid medium comprising the phenol-soluble metal compound may be heated or held (stored) over a period of time prior to use.

The liquid medium comprising the phenol-soluble metal compound is added to the diluent in an amount sufficient to provide from about 1 to less than 2000 wppm, preferably from about 5 to about 950 wppm, more preferably from about 10 to 300 wppm metal constituent of the metal compound, calculated as the elemental metal, based on the weight of the coal in the mixture.

If the liquid medium comprising the phenol-soluble metal compound is added to the diluent first, the coal is subsequently blended into the diluent-poly acid in liquid. Alternatively, the coal may be blended with the diluent prior to the addition or simultaneously with the addition of the metal compound-containing liquid medium.

When the metal compound-containing liquid is added to the diluent, it disperses in the diluent. The coal may already be present in the diluent or the coal may be absent from the diluent when the metal compound-containing liquid is added to the diluent. The metal compound is converted to a catalyst in the diluent by the elevated temperature to which the diluent containing the metal compound is subjected under the conditions of the present invention.

A method of converting the metal compound to a catalyst is to react the mixture of metal compound in diluent plus coal with a hydrogen-containing gas at hydroconversion conditions to produce a catalyst in the chargestock in situ in the hydroconversion zone. The hydrogen-containing gas may comprise from about 1 to about 10 mole percent hydrogen sulfide. Furthermore, the hydrogen-containing gas may be a raw synthesis gas, that is, a gas containing hydrogen and from about 5 to about 50, preferably from about 10 to about 30 mole percent carbon monoxide. The thermal treatment of the metal compound and reaction with a hydrogen-containing gas or with a hydrogen and hydrogen sulfide-containing gas produces the corresponding metal-containing conversion product which is an active catalyst. Whatever the exact nature of the resulting conversion product, the resulting metal component is a catalytic agent and a coking inhibitor.

If desired, prior to the hydroconversion reaction, the phenolic liquid medium comprising the metal compound may be aged by heating and/or standing prior to adding it to the diluent or diluent-coal slurry. Suitable aging period ranges from minutes to several hours or days. The aging may be conducted in the presence of a gas comprising either hydrogen or hydrogen sulfide or mixtures thereof.

The hydroconversion zone is maintained at a temperature ranging from about 200° C. to about 538° C. (392° to 1000° F.), preferably from about 300° C. to about 468° C. (577° to 874.4° F.) and at superatmospheric hydrogen partial pressure e.g. of 100 psig or higher, preferably from about 500 to about 5000 psig partial pressure of hydrogen. Reaction time of about 5 minutes to several hours may be used, preferably from about 15 minutes to about 4 hours. If desired, the hydroconversion can be conducted with staged temperatures. In such a staged operation, the first stage is usually operated at a lower temperature than the second stage, for example, at least 20 Fahrenheit degrees lower, preferably at least 50 Fahrenheit degrees lower, more preferably at least 100 Fahrenheit degrees lower. Contact of the mixture of coal, diluent and catalyst under hydroconversion conditions in the reaction zone with a hydrogen-containing gas effects hydroconversion of the coal to a hydrocarbonaceous oil. The hydroconversion zone oil product containing catalytic solids is removed from the hydroconversion reaction zone. The catalytic solids may be separated from the hydroconversion zone oil product by conventional means, for example, by settling or centrifuging of the slurry. At least a portion of the separated catalytic solids or solids concentrate may be recycled directly to the hydroconversion zone or recycled to the chargestock. A portion of the hydrocarbonaceous oil product may also be recycled to the chargestock or to the hydroconversion zone. The process of the invention may be conducted either as a batch or a continuous type operation. Such continuous operation may be either of the plug flow or backmixed types and may be carried out either in a single reactor or in multiple reactors in series or in parallel configurations.

DESCRIPTION OF THE PREFERRED EMBODIMENTS

The preferred embodiments will be described with reference to the accompanying figures.

Referring to FIG. 1, coal, in particulate form, for example, of 8 mesh (Tyler) in diameter, is introduced by line 10 into mixing zone 12 in which it is mixed with a diluent, for example, a hydrocarbonaceous oil derived from the coal liquefaction process which is introduced into mixing zone 12 by line 14. An admixture comprising about 2 weight percent phosphomolybdic acid in a liquid medium comprising 90 weight percent phenols and 10 weight percent of distillate coal liquids is added to the diluent by line 16 so as to form a mixture of phosphomolybdic acid in phenolic liquid, diluent and coal in mixing zone 12. The admixture comprising phosphomolybdic acid in the liquid medium is added to the diluent in an amount such as to comprise less than 300 weight parts per million (wppm) of molybdenum, calculated as the elemental metal, based on the initial coal in the mixture. The mixture is removed by line 18 and introduced into hydroconversion zone 20 at a feed rate such as to give 15 minutes to 4 hours reaction time. A hydrogen-containing gas is introduced into hydroconversion zone 20 by line 22. The hydroconversion zone is maintained at a temperature ranging from 617° F. to 874.4° F. (325° to 468° C.) and under a hydrogen partial pressure ranging from about 500 to about 3000 psig. The hydroconversion reaction zone effluent is removed by line 24 and introduced into hot separator 26. The overhead of the hot separator is passed by line 28 into gas separator 30. A light liquid hydrocarbon stream is removed from the gas separator by line 32. A gas is removed by line 34. A portion of the gas may be recycled to the hydroconversion zone by line 36. Intermediate liquid hydrocarbons, heavy hydrocarbons and solids are removed by line 38 from hot separator 26 and introduced into distillation tower 40. If desired, solids may be removed from this stream prior to introducing it into distillation tower 40. An intermediate liquid hydrocarbonaceous stream is removed from distillation tower 40 by line 42. A heavy liquid hydrocarbonaceous stream, which may comprise solids (if the solids were not previously removed), is removed from distillation tower 40 by line 44. If desired, a portion of the stream from line 44 may be recycled to mixing zone 12 via line 46 and/or recycled to hydroconversion zone 20 via line 48. Furthermore, if desired, at least a portion of stream 38 may be recycled to hydroconversion zone 20 via line 50 and/or to mixing zone 12 by line 52, either with or without intermediate removal of solids. Furthermore, if desired, at least a portion of solids removed from any of the hydroconversion effluent streams may be recycled to the hydroconversion zone or to the mixing zone.

Figure 2:
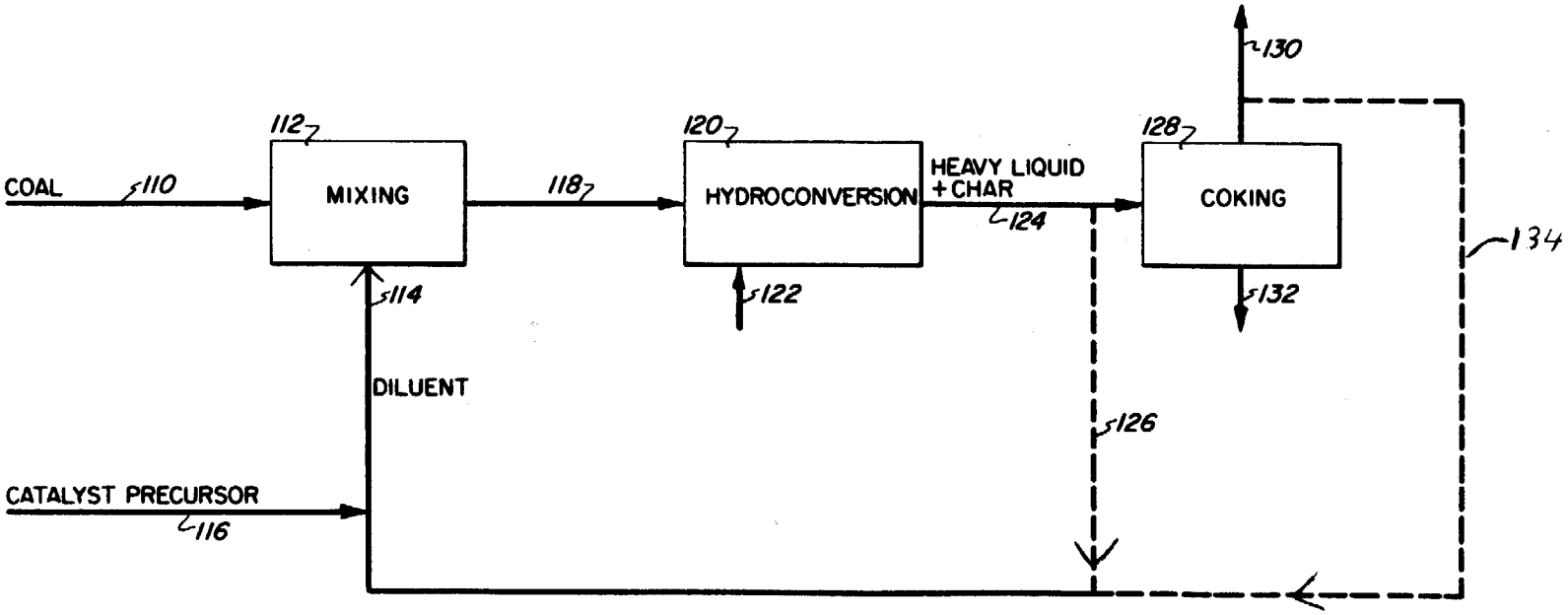
FIG. 2 is a schematic flow plan of another embodiment of the invention.

Referring to FIG. 2, coal is introduced by line 110 into mixing zone 112 in which it is mixed with a diluent introduced into mixing zone 112 by line 114. An admixture comprising about 2 weight percent phosphomolybdic acid in a liquid medium comprising 90 weight percent phenol and 10 weight percent of distillate coal liquids is added to the diluent by line 116 so as to form a mixture of phosphomolybdic acid in liquid medium, diluent and coal in mixing zone 112. The admixture comprising phosphomolybdic acid in the liquid medium is added to the diluent in an amount such as to comprise less than 300 wppm of molybdenum, calculated as the elemental metal, based on the initial coal in the mixture. The mixture is removed by line 118 and introduced into hydroconversion zone 120 at a feed rate such as to give, for example, 2 hours reaction time. A hydrogen-containing gas, which may optionally contain hydrogen sulfide, is introduced into hydroconversion zone 120 by line 122. The hydroconversion zone in this embodiment is preferably maintained at relatively low temperatures, that is, at a temperature ranging from about 300° C. to about 427° C., more preferably from about 325° C. to about 399° C. and at a total pressure ranging from 600 to 2000 psig, preferably from 1000 to 1500 psig. The hydroconversion effluent is removed from the hydroconversion zone and separated by conventional means, for example, by the scheme shown in FIG. 1. The heavy liquid product plus char derived from the hydroconversion zone is removed by line 124. A portion of the heavy liquid stream of line 124 may be recycled by line 126 to mixing zone 112. Another portion of the heavy liquid stream is passed by line 124 into coking zone 128 which may be a delayed coking zone or a fluid coking zone. Delayed coking is a well known process. See *Hydrocarbon Processing*, Sept. 1978, page 103. Fluid coking is a well known process shown, for example, in U.S. Pat. No. 2,881,130, the teachings of which are hereby incorporated by reference. In fluid coking, the coking zone is generally maintained at a temperature ranging from about 850° F. to 1400° F. and a pressure of 0 to 150 psig. The vaporous product of the coker, which includes normally liquid hydrocarbons is removed by line 130. If desired, a portion of the condensed vaporous coker product, for example, a fraction boiling between about 700° and 1000° F. may be recycled by line 134 to mixing zone 112 to serve as diluent. A stream of solid carbonaceous residue is removed by line 132. The solid carbonaceous residue may further be gasified by conventional methods or subjected to partial oxidation to produce a hydrogen-containing gas. The fluid coking process may be an integrated fluid coking and gasification process such as described in U.S. Pat. Nos. 3,661,543; 3,702,516 and 3,759,676, the teachings of which are hereby incorporated by reference. Alternatively, at least a portion of the solid carbonaceous residue may be burned to provide heat to the process.

The following examples are presented to illustrate the invention.

EXAMPLE 1

Comparative experiments were made utilizing phosphomolybdic acid (J. T. Baker & Co. reagent grade $2H_3PO_4 \cdot 20MoO_3 \cdot 48H_2O$) in meta-cresol and in water, respectively, to form a hydrocarbonaceous oil from coal. The chargestock utilized was dried Wyodak coal with 1-methylnaphthalene (a non-hydrogen donor diluent) as the diluent.

These experiments were conducted in a 300 cc autoclave with 1700 r.p.m. stirrer. Stirring was begun at room temperature to dissolve and/or disperse the catalyst percursor solution.

The conditions and results of the experiments are summarized in Table I.

TABLE I

| | | |
|---|---|---|
| Charge: | 46.00 g 200 Mesh Dry Wyodak Coal<br>46.00 g 1-methyl Naphthalene | |
| Reaction Conditions: | | |
| 1st Period: | 820° F., 30 Min; 250 psia $H_2S$, 2245 psia $H_2$ charged at Room Temperature | |
| 2nd Period: | 820° F., 60 Min; 1815 psia $H_2$ Charged at Room Temperature | |
| Run Number | 490 | 491 |
| Catalyst | | |
| Precursor | Phosphomolybdic Acid | Phosphomolybdic Acid |
| Liquid medium | $H_2O$ | m-cresol |
| Concentration of precursor in solvent, wt. % | 4 | 4 |
| Mo on Coal charge, wppm | 102 | 102 |
| Yields, % of Coal Carbon | | |
| Coke | 8.02 | 2.56 |
| $CO + CO_2$ | 5.47 | 4.82 |
| $C_1$-$C_3$ Hydrocarbon | 10.68 | 9.51 |
| Liquid | 75.83 | 83.11 |
| Analyses on total liquid | | |
| Sulfur, wt. % | 0.37 | 0.35 |
| Conradson Carbon, wt. % | 9.44 | 6.72 |
| $H_2$ Consumed, (moles/g Coal) $\times 10^2$ | 2.60 | 2.95 |

EXAMPLE 2

Experiments were made to compare products from a hydrogen donor coal liquefaction process, herein designated "Experiment A", with products prepared from Illinois Coal in a batch autoclave (constant 2400 psig maintained with a flow of hydrogen, 840° F., 60 minutes, 200 wppm molybdenum on coal) herein designated "Experiment B". In Experiment "B", a diluent of 0.95% donatable hydrogen was used. In Experiment "C" the 700° F.+ bottoms of Experiment B were used as diluent. The conditions for Experiment A were 840° F., 1500 to 2000 psig maintained with a flow of hydrogen and no added catalyst precursor nor catalyst. The catalyst precursor of Experiments B and C was the phosphomolybdic acid of Example 1 in meta cresol, which is in accordance with the present invention. The results of these experiments are summarized in Table II.

TABLE II

| | Experiment | | |
|---|---|---|---|
| | A | B | C |
| Diluent | 400-700° F.[1] 1.6% Donatable Hydrogen | 400-700° F.[1] 0.95% Donatable Hydrogen | 700° F.+ Bottoms From B |
| 1000° F.⁻ Liquid Yield, wt. % on coal | 33.5 | 43.1 | 51.6 |
| Distribution of Coal Derived Liquid, wt. % | | | |
| $C_4$-400° F. | 30 | 35 | 40 |
| 400-700° F. | 8 | | 38 |
| 700-1000° F. | 8 | 30 | 5 |
| 1000° F.+ | 54 | 35 | 17 |

[1]Boiling point range of the diluent.

EXAMPLE 3

Batch autoclave experiments were made using the phosphomolybdic acid of Example 1 in m-cresol used as such (fresh) and phosphomolybdic acid in m-cresol heated for 1.5 hours at 140° C. The results of these experiments are summarized in Table III.

As can be seen from Table III, aging the cresol-phosphomolybdic acid mixture gave better hydroconversion results.

TABLE III

| | | |
|---|---|---|
| Charge: | 41.00 g 200 Mesh Dry Wyodak Coal<br>41.00 g 1-methyl Naphthalene | |
| Reaction Conditions: | 820° F., 90 Min, 100 psia $H_2S$, 2650 psia $H_2$ charged at Room Temperature | |
| Run Number | 509 | 510 |
| Catalyst | | |
| Precursor | Phosphomolybdic Acid | Phosphomolybdic Acid |
| Liquid medium | m-cresol | m-cresol |
| Concentration of precursor in liquid medium, wt. % | 0.25 | 0.25 |
| Mo on Coal charge, wppm | 26 | 26 |
| Catalyst Solution age | Fresh | Heated 1.5 hr @ 140° C. |
| Yields, % of Coal Carbon | | |
| Coke | 11.19 | 10.58 |
| $CO + CO_2$ | 5.39 | 5.42 |
| $C_1$-$C_3$ Hydrocarbon | 10.29 | 10.76 |
| Liquid | 73.13 | 73.24 |
| Analyses on Total Liquid | | |
| Sulfur, wt. % | 0.35 | 0.37 |
| Conradson Carbon, wt. % | 11.49 | 10.81 |
| $H_2$ Consumed, (moles/g Coal) $\times 10^2$ | 2.21 | 2.38 |

EXAMPLE 4

A batch autoclave experiment was made utilizing the phosphomolybdic acid of Example 1 in phenolic medium. The conditions and results are summarized in Table IV.

TABLE IV

| | |
|---|---|
| Charge: | 41.00 g 200 Mesh Dry Wyodak Coal<br>41.00 g 1-methyl naphthalene |
| Reaction Conditions: | 820° F., 90 Min., 100 psia $H_2S$, 2650 psia $H_2$ charged at Room |

TABLE IV-continued

| Temperature | |
|---|---|
| Run Number | 517 |
| Catalyst Precursor | Phosphomolybdic Acid |
| Liquid medium | Phenol[1] |
| Concentration of precursor in liquid medium, wt. % | 0.25 |
| Mo on Coal charge, wppm | 26 |
| Yields, % of Coal Carbon | |
| Coke | 9.71 |
| $CO + CO_2$ | 5.25 |
| $C_1$-$C_3$ Hydrocarbon | 10.18 |
| Liquid | 74.86 |
| Analyses on Total Liquid | |
| Sulfur, wt. % | 0.45 |
| Conradson Carbon, wt. % | 10.28 |
| $H_2$ Consumed (moles/g coal) × 100 | 2.38 |

[1]Hydroxy benzene

EXAMPLE 5

Batch autoclave experiments were carried out to illustrate the liquefaction process embodiment comprising the steps of low temperature hydroconversion followed by coking (see process schematic in FIG. 2). The feed for the experiments consisted of a mixture of equal parts by weight of dry, 200 mesh Wyodak coal with a 400°-700° F. boiling range solvent, which had a donor hydrogen content of 0.8 wt. %. The catalyst precursor consisted of one part of the phosphomolybdic acid (PMA) of Example 1 mixed with 99 parts by weight of m-cresol.

For the hydroconversion step, the batch reactor described in Example 1 was charged at room temperature with the following components: 82.0 g of feed mixture, 0.84 g of catalyst precursor blend, 70 psia hydrogen sulfide and 2300 psia hydrogen. The reactor was then heated to 725° F. (385° C.), held at that temperature for a two-hour contact, then cooled to room temperature and vented to recover gaseous products.

The coking reaction was also carried out in the stirred batch reactor and consisted of heating the hydroconversion products remaining after removal of gases for a 15 minute period, starting at an initial temperature of 840° F. and terminating at about 950° F. Steam was injected during the coking reaction to help remove liquid products from the reactor. Pyrolysis liquids and gases were collected and analyzed.

The results of liquefaction using the combined steps of low temperature hydroconversion followed by coking (Run 64-R-54) are shown in Table V relative to the results obtained when the feed mixture was subjected to the coking step alone (Run 64-R-77).

TABLE V

| Experiment No. | 64-R-54 | 64-R-77 |
|---|---|---|
| First Stage | Hydroconversion | None |
| Second Stage | Coking | Coking |
| Yields, Wt. % on Coal | | |
| $CO + CO_2$ | 3.0 | 6.9 |
| $C_1$-$C_3$ | 3.9 | 2.9 |
| $C_4$-1000° F. | 48.3 | 12.8 (Incl. $H_2O$) |
| $H_2O$ (Assumed) | 10.5 | — |
| Ash | 6.2 | 7.7 |
| Char | 28.0 | 69.5 |

TABLE V-continued

| Experiment No. | 64-R-54 | 64-R-77 |
|---|---|---|
| Conversion, % | 72 | 30.5 |
| $H_2$ Consumed, (moles/g coal) × $10^2$ | 1.5 | 0 |

EXAMPLE 6 (Run 698)

Wyodak coal was liquefied in a 300 cc stirred autoclave as follows: A mixture of 0.40 g of phosphomolybdic acid (J. T. Baker & Co. reagent grade 2 $H_3PO_4$.20 $MoO_3$. 48 $H_2O$) and 9.60 g of meta-cresol was shaken on an Eberbach mechanical shaker at the rate of 330 shakes per minute for 10 minutes. The mixture was then allowed to stand for 10 minutes to allow any phosphomolybdic acid crystals which were unconverted to the catalytically active, highly dispersed solid to settle. A 1.12 g portion of this mixture was then added to the autoclave together with a mixture of 46.0 g of 200 mesh (Tyler) dry Wyodak coal and 46.0 g of 1-methyl naphthalene. The molybdenum content of this charge is 475 ppm, calculated as Mo, based on coal. After flushing the autoclave with hydrogen, it was charged with 250 psia of $H_2S$ and 2230 psia $H_2$. The stirrer was started at 1700 rpm and the autoclave heated to 820° F. over a period of 32 minutes and held at this temperature with stirring for 30 minutes, then cooled to room temperature. The gases were collected, measured and analyzed by mass spectrometry. The autoclave was then pressured to 1600 psi with $H_2$, heated with stirring to 820° F. over a period of 32 minutes and held at this temperature for 1 hr. and then cooled to room temperature. The gases were collected, measured, and analyzed by mass spectrometry. The autoclave contents were discharged and filtered. All solids were recovered and freed of oil by toluene washing. The solids, after drying in a vacuum oven at 180° C. for 1 hour, weighed 4.78 g and by analysis contained 13.05% carbon. Yields of gases and coke were calculated from the analyses on the basis of percentage of carbon in the coal charge; the liquid yield was then taken by difference from 100%. Results are tabulated in Table VI (see run 698).

EXAMPLE 7 (Runs 699, 700, 702, 703, 704)

Coal liquefaction runs were made according to Example 6 except the liquid media for the catalyst precursor used were as follows: 75 weight percent m-cresol, 25 weight percent toluene; 50 weight percent m-cresol, 50 weight percent toluene; 25 weight percent m-cresol, 75 weight percent toluene; 15 weight percent m-cresol, 85 weight percent toluene; 65°-425° F. coal liquefaction liquid containing 11.6 weight percent phenol and 13.5 weight percent cresol.

The results are summarized in Table VI. As can be seen from the data of Table VI, runs in which the phenol concentration of the liquid medium was above 25 weight percent, that is, runs No. 700, 703, and 698, which were runs in accordance with the present invention, gave better coal liquefaction results than runs in which the phenol concentration of the liquid medium was about 25 weight percent (Runs 704 and 702) or lower (run 699). Runs 704, 702 and 699 are not runs in accordance with the present invention.

TABLE VI

| Run No. | 698 | 703 | 700 | 704 | 699 | 702 |
|---|---|---|---|---|---|---|
| Liquid medium | 100 wt. % | 75 wt. % | 50 wt. % | 25 wt. % | 15 wt. % | 65-425° F. |

TABLE VI-continued

| Run No. | 698 | 703 | 700 | 704 | 699 | 702 |
|---|---|---|---|---|---|---|
| | m-cresol | m-cresol, 25 wt. % Toluene | m-cresol, 50 wt. % Toluene | m-cresol, 75 wt. % Toluene | m-cresol, 85 wt. % Toluene | Coal Liquefaction Liquid Containing 11.6 wt. % Phenol and 13.5 wt. % Cresol |
| Yields, % of Coal Carbon | | | | | | |
| Coke | 2.35 | 2.21 | 2.58 | 25.9 | 30.41 | 20.53 |
| $CO + CO_2$ | 5.75 | 5.48 | 5.77 | 5.78 | 5.81 | 6.06 |
| $C_1$-$C_3$ Hydrocarbon | 9.44 | 9.01 | 7.20 | 9.16 | 9.06 | 11.56 |
| Liquid | 82.46 | 83.30 | 84.45 | 59.2 | 54.71 | 61.85 |
| $H_2$ Consumed (moles/g Coal) $\times 10^2$ | 2.61 | 2.68 | 2.11 | 1.90 | 1.64 | 2.23 |

What is claimed is:

1. In a process for the hydroconversion of coal in a diluent, which comprises the steps of:

(a) forming a mixture of coal, a diluent and a phenol-soluble metal compound wherein said metal compound comprises at least one metal constituent selected from the group consisting of Groups II, III, IVB, VB, VIB, VIIB, VIII and mixtures thereof of the Periodic Table of Elements;

(b) reacting the resulting mixture with a hydrogen-containing gas at hydroconversion conditions, said metal compound being converted to a catalyst within said mixture at said conditions, and (c) recovering a normally liquid hydrocarbon product, the improvement which comprises adding to said diluent an admixture comprising said metal compound and a liquid medium, said liquid medium comprising at least about 30 weight percent of at least one phenol, based on said liquid medium, and said metal compound comprising not more than about 50 weight percent of said admixture.

2. The process of claim 1 wherein said phenol-soluble metal compound is selected from the group consisting of inorganic poly acids, metal carbonyls, metal halides and metal salts of organic acids.

3. The process of claim 1 wherein said phenol-soluble metal compound is an inorganic poly acid selected from the group consisting of isopoly acids, heteropoly acids and mixtures thereof wherein said poly acid comprises at least one metal constituent selected from the group consisting of Groups VB and VIB of the Periodic Table of Elements.

4. The process of claim 1 wherein said liquid medium comprises at least about 50 weight percent of said phenol.

5. The process of claim 1 wherein said phenol is an individual phenol or mixture of phenols.

6. The process of claim 1 wherein said metal compound is added in an amount such as to provide from about 1 to about 2000 wppm of said metal constituent, calculated as the elemental metal, based on the weight of said coal.

7. The process of claim 1 wherein said diluent is a hydrocarbonaceous bottoms fraction derived from a coal liquefaction process.

8. The process of claim 7 wherein said hydrocarbonaceous bottoms fraction has an initial boiling point ranging from about 350° to about 700° F.

9. The process of claim 1 wherein said hydroconversion conditions include a temperature ranging from about 200° C. to about 538° C.

10. The process of claim 1 wherein prior to reacting said mixture at hydroconversion conditions including a temperature ranging from 200° C. to 538° C., the mixture resulting from step (a) is aged.

11. The process of claim 1 wherein said coal of step (a) is wet coal and wherein said hydrogen-containing gas of step (b) also comprises from about 5 to about 50 mole percent carbon monoxide.

12. The process of claim 1 wherein said hydrogen-containing gas of step (b) also comprises hydrogen sulfide.

13. The process of claim 1 wherein said metal compound is a phosphomolybdic acid.

14. In the process of claim 1 wherein the reaction product resulting from step (b) comprises a hydroconverted oil containing catalytic solids, the additional steps which comprise separating at least a portion of said catalytic solids from the hydroconverted oil and recycling at least a portion of said catalytic solids to step (a) or to step (b).

15. The process of claim 1 wherein a portion of said normally liquid hydrocarbon product is recycled to step (a) or to step (b).

16. In the process of claim 1, the additional steps of separating said normally liquid product of step (c) into at least one lighter boiling fraction and a heavier bottoms fraction, and recycling at least a portion of said heavier bottoms fraction to step (a) or to step (b).

17. In the process of claim 1, the additional steps of separating said normally liquid product of step (c) into at least one lighter boiling fraction and a heavier bottoms fraction, and passing at least a portion of said bottoms fraction to a coking zone maintained at coking conditions to produce a vaporous coker product including normally liquid hydrocarbons.

18. The process of claim 17 wherein another portion of said heavier bottoms fraction is recycled to step (a) or to step (b).

19. The process of claim 18 wherein said hydroconversion conditions include a temperature ranging from about 300° C. to about 427° C.

20. The process of claim 1 wherein said liquid medium comprises hydrocarbonaceous liquids.

21. The process of claim 1 wherein said liquid medium comprises coal derived hydrocarbonaceous liquids.

22. The process of claim 1 wherein said diluent is hydrocarbonaceous.

* * * * *